US010639624B2

(12) United States Patent
Dudek

(10) Patent No.: US 10,639,624 B2
(45) Date of Patent: May 5, 2020

(54) MULTICHANNEL PIPETTING SYSTEM COMPRISING TWO ASPIRATION CHAMBERS THAT ARE IMBRICATED IN ONE ANOTHER

(71) Applicant: GILSON SAS, Villiers le Bel (FR)

(72) Inventor: Bruno Dudek, Montgresin (FR)

(73) Assignee: GILSON SAS, Villiers le Bel (FR)

( * ) Notice: Subject to any disclaimer, the term of this patent is extended or adjusted under 35 U.S.C. 154(b) by 267 days.

(21) Appl. No.: 15/302,358

(22) PCT Filed: Apr. 9, 2015

(86) PCT No.: PCT/EP2015/057788

§ 371 (c)(1),
(2) Date: Oct. 6, 2016

(87) PCT Pub. No.: WO2015/155317

PCT Pub. Date: Oct. 15, 2015

(65) Prior Publication Data

US 2017/0028397 A1 Feb. 2, 2017

(30) Foreign Application Priority Data

Apr. 10, 2014 (FR) ..... 14 53185

(51) Int. Cl.
*B01L 3/02* (2006.01)

(52) U.S. Cl.
CPC ..... *B01L 3/0231* (2013.01); *B01L 2300/0861* (2013.01); *B01L 2400/0478* (2013.01)

(58) Field of Classification Search
CPC combination set(s) only.
See application file for complete search history.

(56) References Cited

U.S. PATENT DOCUMENTS

| | | | |
|---|---|---|---|
| 2,826,339 | A | 3/1958 | Maillard |
| 2,946,486 | A | 7/1960 | Gilmont |
| 4,096,751 | A | 6/1978 | Withers et al. |
| 4,228,831 | A | 10/1980 | Kerns |
| 4,527,437 | A | 7/1985 | Wells |
| 4,760,939 | A | 8/1988 | Ball et al. |
| 4,929,428 | A | 5/1990 | Tezuka |
| 5,330,721 | A | 7/1994 | Tervamaki |
| 5,406,856 | A | 4/1995 | Kuhn |

(Continued)

FOREIGN PATENT DOCUMENTS

| | | |
|---|---|---|
| EP | 0547503 A1 | 6/1993 |
| EP | 1344565 A1 | 9/2003 |

(Continued)

OTHER PUBLICATIONS

French Preliminary Search Report dated Dec. 17, 2014 for French Application No. 1453185.
International Search Report dated Oct. 6, 2015 for PCT Application No. PCT/EP2015/057788.
French Preliminary Search Report dated Dec. 12, 2013 for related French Application No. 1353039.
International Search Report dated Jun. 6, 2014 for related PCT Application No. PCT/EP2014/056533.

(Continued)

*Primary Examiner* — Brian R Gordon
(74) *Attorney, Agent, or Firm* — Miles & Stockbridge, P.C.

(57) ABSTRACT

The invention relates to a device (32) for the bottom part of a multichannel pipetting system, comprising two sampling-cone-holding end pieces (6) and also two aspiration chambers (36*a*, 36*b*) that engage respectively with the two end pieces, the two aspiration chambers (36*a*, 36*b*) being concentric.

10 Claims, 6 Drawing Sheets

(56) References Cited

U.S. PATENT DOCUMENTS

| | | | | |
|---|---|---|---|---|
| 5,528,923 | A * | 6/1996 | Ledez | G01N 7/14 73/19.02 |
| 5,879,633 | A | 3/1999 | Tervamaki et al. | |
| 5,970,806 | A * | 10/1999 | Telimaa | B01L 3/0217 73/864.17 |
| 6,428,750 | B1 | 8/2002 | Rainin | |
| 6,455,006 | B1 | 9/2002 | Mukal | |
| 7,988,934 | B2 | 8/2011 | Balmer | |
| 8,029,742 | B2 | 10/2011 | Butz et al. | |
| 8,829,473 | B1 * | 9/2014 | Griswold | B01L 3/545 250/461.2 |
| 2013/0291660 | A1 | 11/2013 | Wilmer et al. | |
| 2014/0050620 | A1 * | 2/2014 | Johnson | G01N 33/50 422/68.1 |
| 2016/0059229 | A1 | 3/2016 | Dudek | |

FOREIGN PATENT DOCUMENTS

| | | | |
|---|---|---|---|
| EP | 1559480 | A1 | 8/2005 |
| JP | 62-43634 | U | 3/1987 |

OTHER PUBLICATIONS

Office Action notification dated Sep. 13, 2016 for related U.S. Appl. No. 14/781,569.

Notice of Allowance dated Feb. 17, 2017 in U.S. Appl. No. 14/781,569.

* cited by examiner

MULTICHANNEL PIPETTING SYSTEM COMPRISING TWO ASPIRATION CHAMBERS THAT ARE IMBRICATED IN ONE ANOTHER

TECHNICAL FIELD

The present invention relates to the field of multichannel pipetting systems, such as multichannel sampling pipettes, also called laboratory pipettes or even air displacement liquid transfer pipettes, for calibrated liquid sampling and introduction in containers.

The invention is preferably applicable to sampling pipettes intended to be handheld by an operator during liquid sampling and dispensing operations, but is also applicable to automated pipetting systems.

STATE OF PRIOR ART

In prior art, there are known multichannel sampling pipettes having a design of the type integrating a handle body, as well as a bottom part having at the end thereof several pipettes sampling-cone-holder end pieces, the known function of which is to hold sampling cones, also called consumables.

The bottom part thus comprises a fixed body having at the lower end thereof a plurality of sampling-cone-holder end pieces, spaced apart from each other along a pipette lateral direction, so as to form a row. Each sampling-cone-holder end piece has a through port communicating with an aspiration chamber.

Parallel pistons are respectively accommodated in the aforementioned aspiration chambers, and mounted at the upper end thereof on a piston-holder translationally movable with respect to the fixed body. Indeed, the piston-holder is usually driven by a manual or motorised equipment imposing it a raising stroke during liquid sampling phases, and a lowering stroke during liquid transfer phases, the raising stroke being generally made under the expansion effect of a previously compressed spring during the previous lowering stroke.

During its movement, the piston-holder drives, together with it, the pistons connected thereto, such that the latter are consequently capable of being simultaneously moved along a sliding direction, usually parallel to the longitudinal centre axis of the pipette.

It is reminded that the sampled volume depends on the piston stroke, and the transverse cross-section area of its aspiration chamber associated. Thus, when the liquid volume to be sampled in each cone is high, for example in the order of 1 200 μl, it is necessary to increase one or both aforementioned parameters. However, too high an increase in the piston stroke can turn out to be problematic in terms of ergonomics for the operator. Further, too high an increase in the piston diameter and its aspiration chamber can generate overall space problems at the bottom part of the pipette. These overall space problems can become severe such that the pitch between the sampling-cone-holder end pieces may not be met, this pitch being generally dictated by the pitch between the different liquid receptacles provided on a microtitration plate.

In prior art, solutions have been provided to solve the problems identified above, as the arrangement of pistons in a staggered fashion, but these solutions are not fully satisfactory and they turn out to be perfectible accordingly.

On the other hand, analogous drawbacks exist for automated pipetting systems.

DISCLOSURE OF THE INVENTION

Thereby, one object of the invention is to provide a solution overcoming at least partially the abovementioned problems, met in solutions of prior art.

For this, one object of the invention is first to provide a device for a bottom part of a multichannel pipetting system, comprising two sampling-cone-holding end pieces as well as two aspiration chambers respectively engaging with both end pieces, both aspiration chambers being concentric.

In other words, the invention is fully different from the usual design of multichannel pipetting systems, by arranging coaxially both aspiration chambers. This specificity enables the overall space to be reduced with respect to a conventional solution with adjacent aspiration chambers. The invention thus enables a very satisfactory compromise to be proposed, since the multichannel pipetting system arising therefrom can have a reduced overall space, a satisfactory piston stroke from an ergonomic point of view, a conventional pitch between both end pieces, even for high sampling volumes.

Further, the dispersion phenomenon, related to displacement differentials of the pistons engaging with the aspiration chambers, can be advantageously reduced with the design with concentric chambers. The friction strains of the pistons in the chambers can thus be potentially decreased. Finally, the solution provided by the invention remains readily implantable on existing multichannel pipetting systems.

According to a first preferred embodiment of the invention, the device comprises two pistons respectively engaging with said two aspiration chambers, both pistons being imbricated in one another.

Both pistons are translationally secured along their sliding direction in the aspiration chambers. For example, they are made as a single piece.

Both aspiration chambers are arranged one around the other, even if it could be different, without departing from the scope of the invention. Indeed, alternatively, both chambers can be axially offset from each other without covering each other, while remaining concentric, thus with one located external to the other.

A first of both aspiration chambers has a solid transverse cross-section, and a second of both chambers has a recessed transverse cross-section. Preferably, even if the shapes can differ, it is contemplated that the first aspiration chamber has a substantially disc-shaped transverse cross-section, and that the second aspiration chamber has a substantially annular shaped transverse cross-section. Alternatively, instead of a disc shape for the first aspiration chamber, an oval shape or any other analogous shape could be retained. It is noted that the pistons have shapes complementary to those of their associated aspiration chambers.

According to a second preferred embodiment contemplated, the device comprises a first aspiration chamber and a second aspiration chamber, as well as first and second pistons respectively engaging with said aspiration chambers, said second aspiration chamber having a substantially annular shaped transverse cross-section and being defined between an internal body and an external body, said second piston being accommodated in the second chamber being generally in the form of a sealed ring at one of its axial ends by a seal forming said first piston, said first aspiration chamber being axially delimited between the seal and an axial end of said internal body, and laterally delimited by the second piston.

This second embodiment has the advantage of an easier manufacturability.

Regardless of the preferred embodiment contemplated, the invention has at least one of the following optional characteristics, taken alone or in combination. The centre axes of both end pieces are spaced apart from each other with a pitch of 9 mm, traditionally found in microtitration plates.

Both end pieces are each equipped with a through port, centred or not relative to its associated end piece. The possibility to off-centre these through ports offer a further degree of freedom for designing the device, promoting a decrease in its overall space.

Both aspiration chambers have respectively, in a transverse cross-section, identical or different surface areas. When the surface areas differ, the aspiration chambers enable samplings of different values, called multivolume samplings, to be performed. This opportunity is for example particularly interesting for making assay operations.

The device is preferentially equipped with only two end pieces. However, a number N of end pieces with N higher than or equal to 3 remains possible. In this case, only the inner most aspiration chamber has a solid cross-section, the other being preferentially recessed, imbricated in one another. In addition, the N end pieces are then preferably aligned to form a row, even if other configurations could be retained, without departing from the scope of the invention.

One object of the invention is also to provide a bottom part of a multichannel pipetting system, comprising at least one device as described above, and preferably a plurality of these devices.

Preferably, the devices are arranged such that the centre axis of each end piece of the bottom part intercepts a same straight line, so as to form a row of end pieces. Preferably, the devices are aligned along this straight line, or possibly arranged in a staggered fashion. Alternatively, to form N rows of end pieces with N corresponding to the number of end pieces per device, these same devices can then be aligned along a direction orthogonal to a spacing direction between the end pieces of a same device.

Preferably, in a transverse cross-section, at least one of the aspiration chambers of one of the devices has a surface area different from that of at least one of the aspiration chambers of at least one other device equipping the bottom part. Once again, this feature enables multivolume samplings to be made.

Finally, one object of the invention is to provide a multichannel pipetting system comprising a bottom part as described above, said system being preferentially a manual or motorised sampling pipette. Alternatively, this could be an automated pipetting system.

Further advantages and characteristics of the invention will appear in the non-limiting detailed description below.

BRIEF DESCRIPTION OF THE DRAWINGS

This description will be made in view of the appended drawings from which.

DETAILED DISCLOSURE OF PREFERRED EMBODIMENTS

Figure 1:
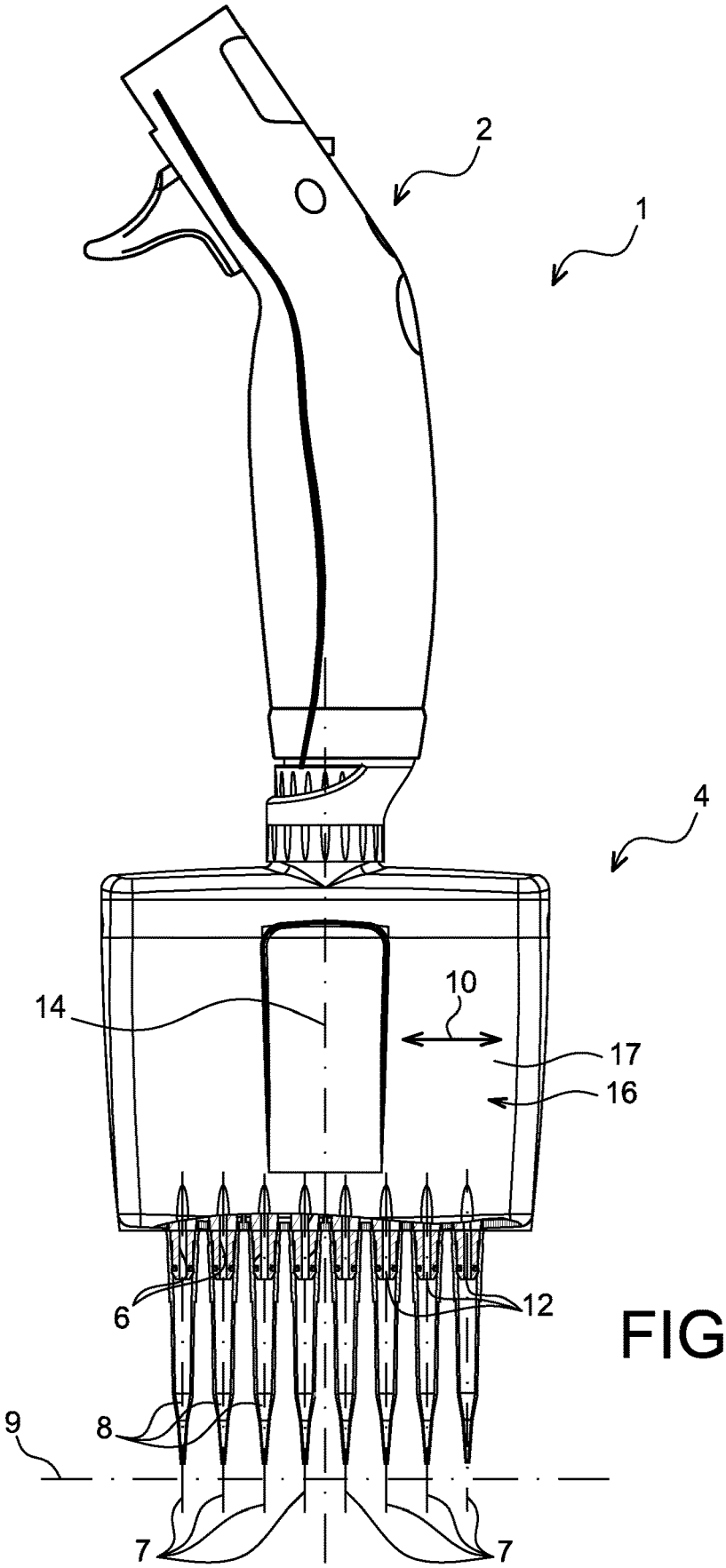
FIG. 1 represents a front view of an air displacement multichannel sampling pipette, according to a preferred embodiment of the invention.
Figure 2:
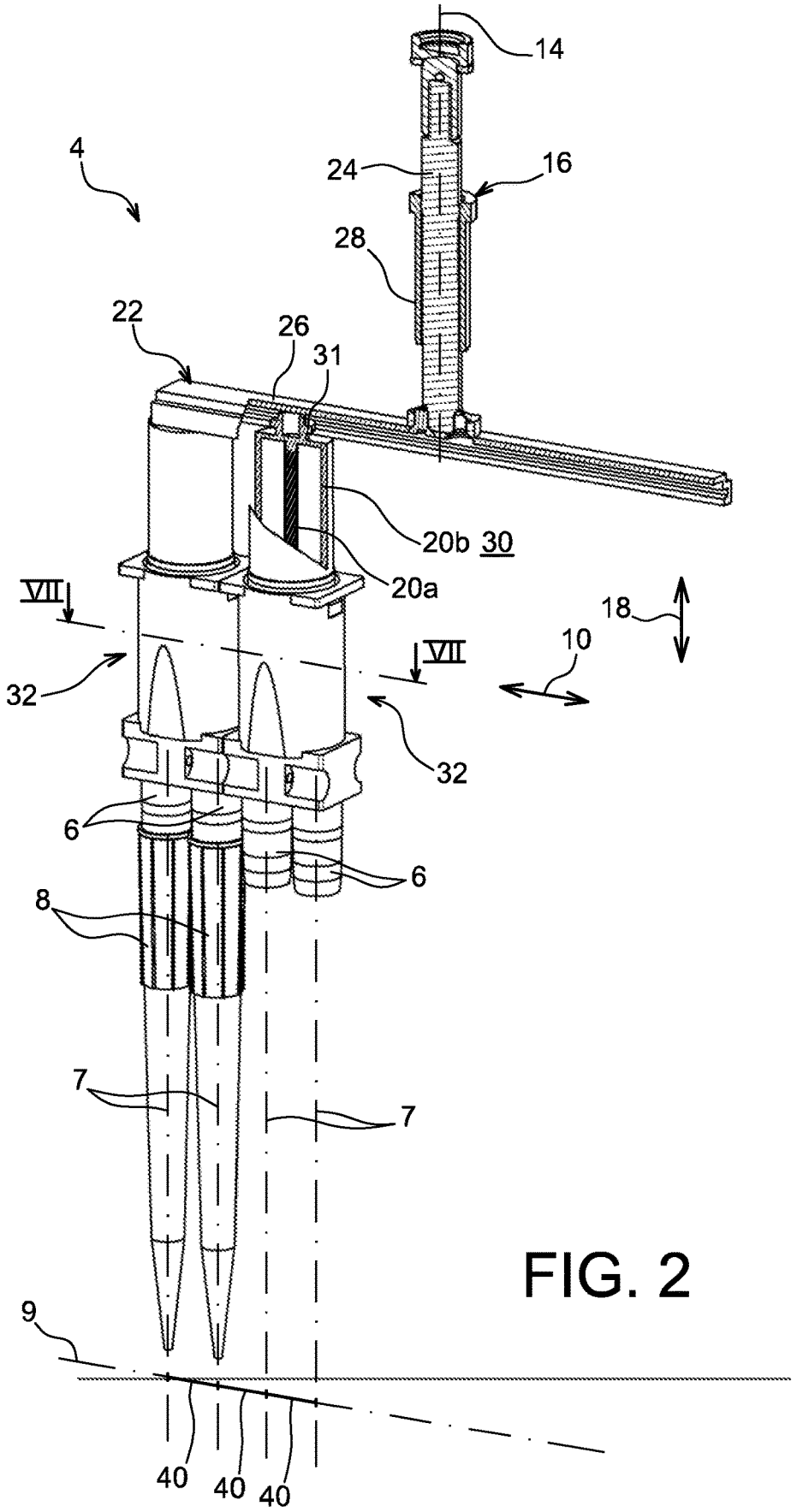
FIG. 2 represents a partial enlarged view of the bottom part of the pipette shown in the previous figure.
Figure 3:
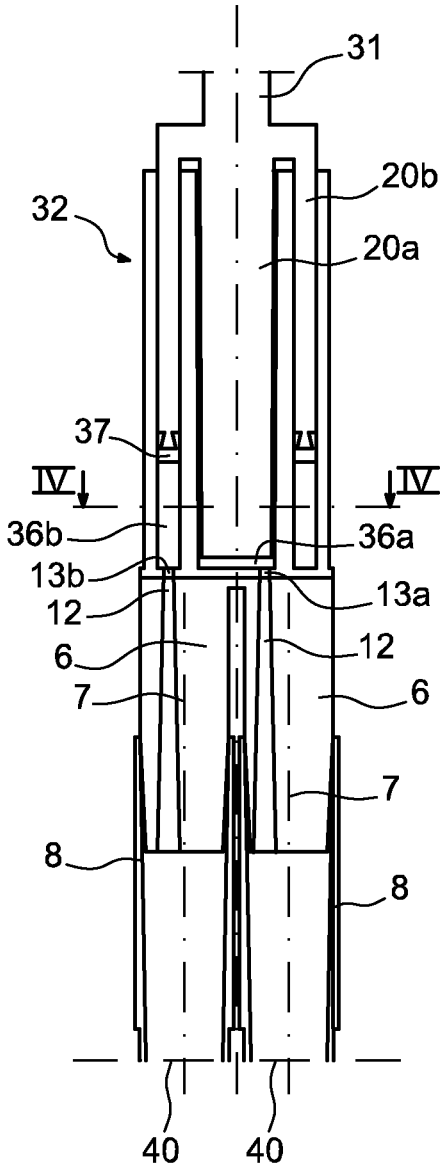
FIG. 3 represents an enlarged longitudinal cross-section view of a device specific to the invention, equipping the bottom part of the pipette, said device having the form of a first preferred embodiment of the invention.
Figure 4:
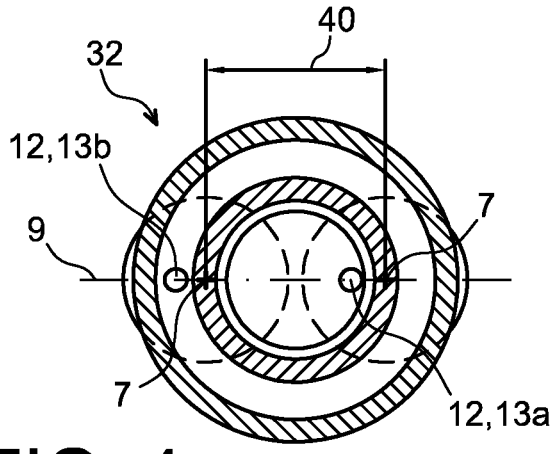
FIG. 4 is a cross-section view taken along line IV-IV of FIG. 3.
Figure 5:
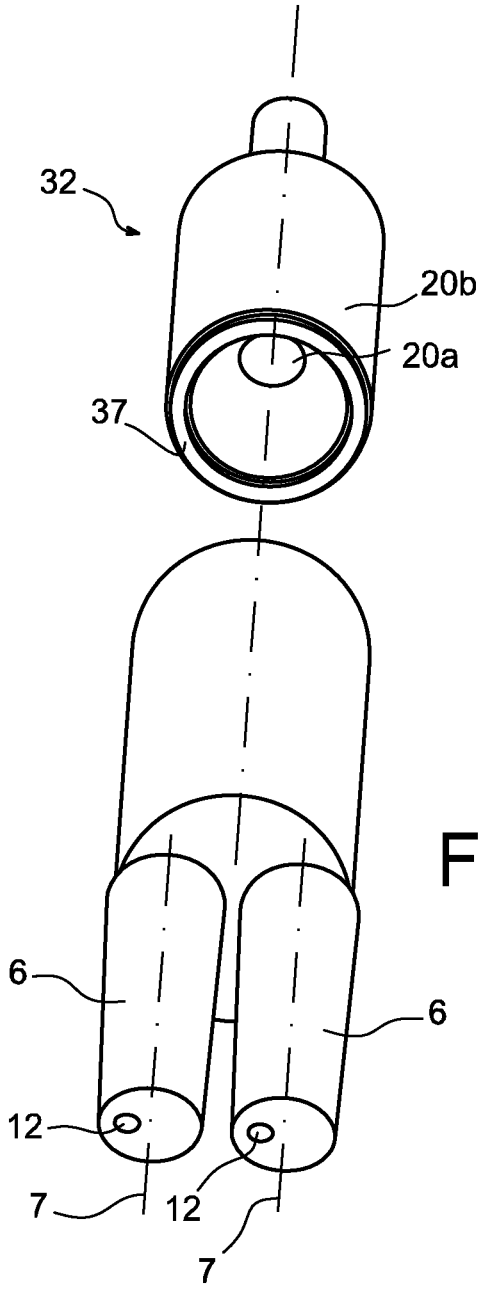
FIG. 5 is a perspective exploded view of the device shown in FIGS. 3 and 4.
Figure 6:
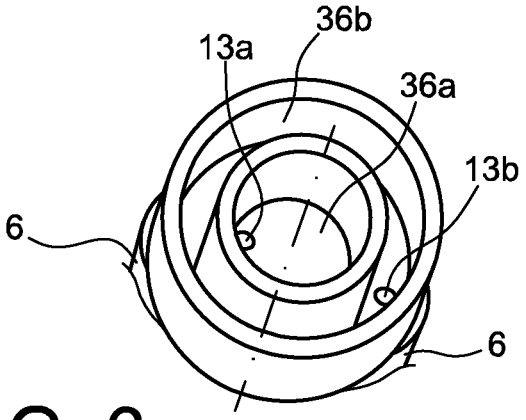
FIG. 6 represents a perspective view of the fixed part of the device shown in FIGS. 3 to 5, according to another view angle.
Figure 7:
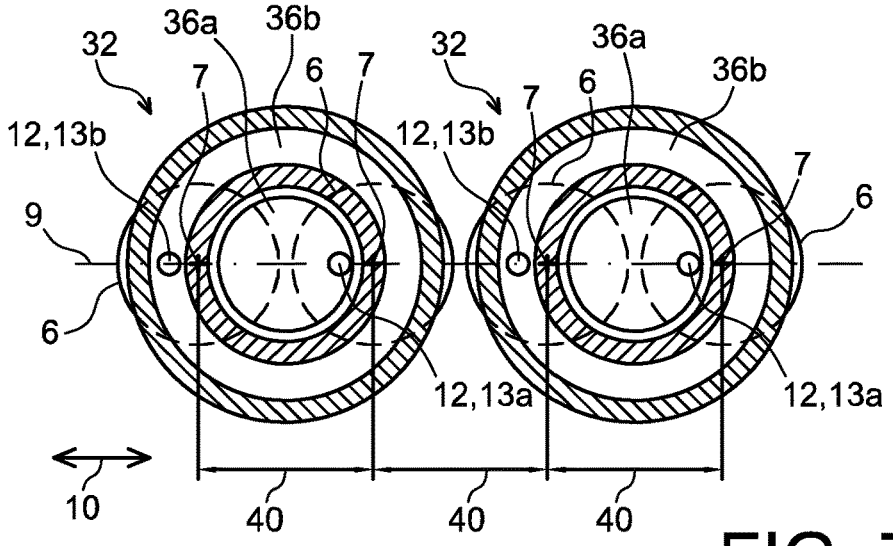
FIG. 7 represents a cross-section view taken along line VII-VII of FIG. 2.

In reference first to FIG. 1, a multichannel sampling pipette 1 is represented according to a preferred embodiment of the present invention. However, the invention is not limited to pipettes, but is applicable to any multichannel pipetting system, and in particular to automated pipetting systems, called automatons.

The manual or motorised air displacement pipette 1 comprises at the upper part, a handle body 2, as well as a bottom part 4 also object of the present invention, integrating at the lower end thereof, pipette-sampling-cone-holder end pieces 6, on which cones or consumables 8 are intended to be fitted.

The sampling-cone-holder end pieces 6 are spaced apart from each other, along a lateral direction of the pipetting system, or even pipette lateral direction, represented by the arrow 10. Each end piece 6 has a through port 12 communicating at the upper end thereof with an aspiration chamber (not visible in FIG. 1), and at the lower end thereof, with a sampling cone 8. The through port 12 is centred or not on its associated end piece 6, that is it is centred or not on a centre axis 7 of the end piece on which the fitted cone is centred.

The pipette 1 has a longitudinal centre axis 14, also corresponding to a longitudinal centre axis of the bottom part 4. This axis 14 is orthogonal to the lateral direction 10, and usually placed so as to have an identical number of end pieces 6 disposed on either side of the same, in the lateral direction. Further, generally, the axis 14 is parallel to the axes of the through ports 12 and to the axes 7 of their associated cones 8, and also parallel to a sliding direction of the movable elements of the pipette bottom part 4, which will be described hereinafter.

In the example shown in FIG. 1, there are eight end pieces 6 aligned along the direction 10, so as to form a row. Thus, the centre axis 7 of each end piece 6 intercepts a same straight line 9 extending along the direction 10.

As is known to those skilled in the art, the bottom part 4 is preferentially screwedly mounted on the handle body 2.

One of the features of the invention is in the design of the bottom part 4, which will be first detailed in reference to FIGS. 2 to 7 representing a first preferred embodiment.

In a known manner, the bottom part 4 comprises a fixed body 16, as well as an assembly movable with respect to this fixed body, along a sliding direction 18 parallel to the axis 14 and orthogonal to the lateral direction 10. The movable assembly first has a plurality of pistons 20*a*, 20*b* parallel to the direction 18, and each associated with an end piece 6.

The movable assembly also has a piston-holder 22 located overall above the pistons 20*a*, 20*b*, this piston-holder comprising a guide rod 24 centred on the axis 14, as well as a piston supporting head 26 integral with the bottom part of the rod 24. The head 26, arranged in parallel to the lateral direction 10, thus orthogonal to the sliding 20 direction 18 as well as to the axis 14, takes the form of a rack accommodating a connector 31 at an upper end of the pistons between its teeth. More precisely, the upper ends of the piston are translationally blocked by the rack in both sliding directions 18, in order to be able to follow the reciprocating movement of the piston-holder along this same direction.

The fixed body 16 of the pipette bottom part is made using several elements integral with each other, added or made as a single piece. This is first a guide cylinder 28 centred on the axis 14 and slidingly accommodating the rod 24 of the movable piston-holder. In addition, a structure 30 arranged below the cylinder 28 is provided to delimit a sliding space of the supporting head 26, this structure being substantially oriented along a plane parallel to the directions 10 and 18. As is shown in FIG. 1, an external removable cap 17 completes the fixed body 16, this cap covering the structure 30 and the devices 32 which will be described below overall, such that only a lower part of the end pieces 6 is projecting outside this cap.

The bottom part 4 indeed includes a plurality of individual devices 32, specific to the present invention. These are four devices aligned along the straight line 9. Each of these devices 32 defines two end pieces 6, also deviated from each other along the straight line 9 and the direction 10. The fixed parts of these devices 32 can be independent from each other and added on the fixed body 16 of the bottom part, or even made as a single piece added on this same fixed part. Both end pieces 6 are added to the other fixed parts of the device 32.

Each device 32 defines with the upper fixed portion thereof two concentric aspiration chambers 36*a*, 36*b*, the internal chamber 36*a* being surrounded by the external chamber 36*b*. In this regard, it is noted that both imbricated aspiration chambers 36*a*, 36*b* cover axially each other on at least one axial portion thereof, but not necessarily on their entire axial lengths.

The internal aspiration chamber 36*a*, or first chamber, has a substantially disc shaped transverse cross-section, whereas the external aspiration chamber 36*b*, or second chamber 36*b*, has a substantially annular shaped transverse cross-section. In transverse cross-sections, both chambers 36*a*, 36*b* have identical surface areas to obtain a same sampling volume, or different surface areas in order to perform multivolume samplings. In this regard, it is indicated that this possibility of different volumes is possible between both chambers of a same device 32, but also between various devices. For this, it is provided that at least one of the aspiration chambers 36*a*, 36*b* of one of the devices 32 has a different surface area from that of at least one of the aspiration chambers 36*a*, 36*b* of at least one other device 32 of the bottom part.

Each chamber 36*a*, 36*b* slidingly accommodates a piston 20*a*, 20*b*, respectively. Thus, the device 32 includes two pistons 20*a*, 20*b* having complementary shapes to those of their respective chambers, such that the internal piston 20*a* takes the form of a cylinder, and the external piston 20*b* that of a ring. Both pistons 20*a*, 20*b* are preferably made as a single piece, and attached to the rack 26 by the same mechanical connector 31, preferably integrated to the single piece part. Both pistons 20*a*, 20*b* are thus imbricated in one another.

The sealing of both chambers 36*a*, 36*b* is for example achieved by placing an O-ring 37 at the distal end of the second piston 20*b*, facing the bottom of the aspiration chamber 36*b*. It is precisely at this chamber bottom that is provided a port 13*b* allowing the air communication with the port 12 of the end piece, and thus allowing the air communication with the cone 8. The same is true for the bottom of the internal chamber 36*a*, by virtue of making a port 13*a*.

By concentrically arranging the aspiration chambers 36*a*, 36*b*, as well as the associated pistons, it is possible to reduce the overall space of the bottom part, and to respect a suitable pitch 40 between the centre axes of the end pieces. This pitch 40 can not only be met between both end pieces 6 of a same device 32, but also between the end pieces 6 facing each other two by two, belonging to adjacent devices. The top part of the devices 32 has indeed a lateral overall space, along the direction 10, which is lower than the cumulative overall space of both end pieces 6. By way of indicating example, with a pitch 40 set to 9 mm, each chamber 36*a*, 36*b* can has a cross-section area in the order of 75 $mm^2$, with a piston pipetting stroke set to 16 mm. This enables liquid samples with a high volume to be sampled, while having a reduced overall space and a satisfactory ergonomics. In particular, the external diameter of the chamber 36*b* can be substantially lower than twice the value of the pitch 40 of 9 mm, since it is in the order of 14.6 mm.

In a known manner, the guide rod 24 of the piston-holder 22 is driven by a manual or motorised equipment imposing it a raising stroke during liquid sampling phases, and a lowering stroke during liquid transfer phases. The raising stroke is generally made in a manual mode, under the expansion effect of a previously compressed spring during the previous lowering stroke. During its movement, the piston-holder 22 drives together with it the pistons 20*a*, 20*b* integral with the rack 26, such that the latter are consequently capable of being simultaneously moved along the sliding direction 18. The raising stroke imposed to the assembly movable with respect to the fixed body 16 determines the liquid volume sampled, which volume is precisely previously set by the user, by means for example of a knob, a set screw or even a numeric keypad.

Figure 8:
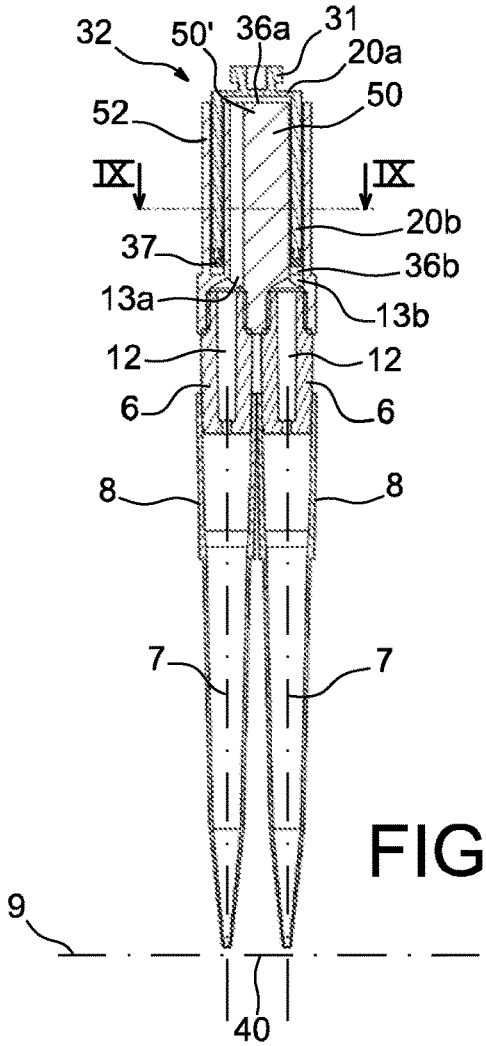
FIG. 8 represents a view similar to that of FIG. 3, with the device having the form of a second preferred embodiment of the invention.
Figure 9:
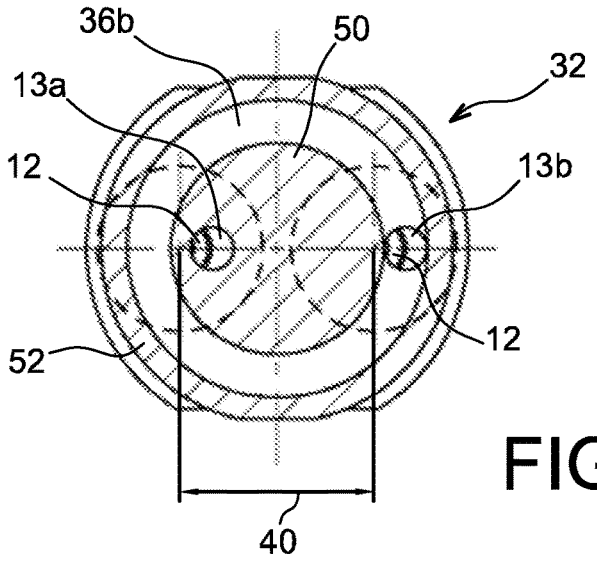
FIG. 9 is a cross-section view taken along line IX-IX of FIG. 8.
Figure 10:
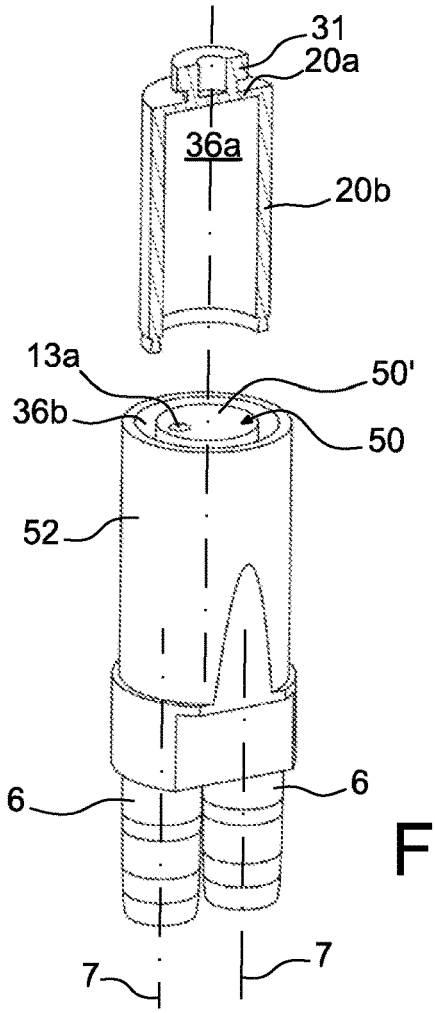
FIG. 10 is a perspective exploded view of the device shown in FIGS. 8 and 9.

In reference now to FIGS. 8 to 10, is represented a device 32 according to a second preferred embodiment of the invention, which is characterised by a simplified manufacture. The second embodiment has numerous similarities with the first embodiment described above. Thus, in the figure, elements having the same reference numerals correspond to identical or similar elements.

In this second preferred embodiment, the main difference with the first embodiment lies in the design of the first piston 20*a*.

Indeed, the second piston 20*b* remains identical to that previously described, by being accommodated in the chamber 36*b* the transverse cross-section of which is substantially annular shaped, by being defined between an internal body 50 and an external body 52 of the upper fixed part of this device 32. The internal body 50 is cylindrical with a disc-shaped cross-section, whereas the external body 52, arranged around and remotely from the internal body 50 has a substantially annular transverse cross-section.

The second piston 20*b* accommodated in the second chamber 36*b* thus maintains its general ring shape, sealed at the top axial end thereof by a seal. One of the features of this second embodiment lies in the fact that this seal, being disc-shaped and arranged substantially orthogonal to the axes 7, makes up the first piston 20*a*.

Both pistons 20*a*, 20*b* thus remain concentric, while being placed one 20 above the other. With this arrangement, the first aspiration chamber 36*a* is axially delimited between the top end of the first piston 20*a* which provides the seal and the top axial end 50' of the internal body 50, and laterally delimited by the internal surface of the second piston 20*b*. In operation, the lateral wall of the second chamber 36*b* thus has the feature to be movable, because it consists of the second piston 20*b*. Both chambers 36*a*, 36*b* remain concentric also, while being arranged one above the other.

The internal body 50 is pierced with a port 13*a* which opens into the bottom of the chamber 36*a*, at the top axial end 50'. It extends, in a centred way or not, through the entire internal body 50, to open into the port 12 of the associated end piece 6. In the same way, the port 13*b* ensures air communication between the annular chamber 36*b* and the port 12 of the associated end piece 6.

Of course, various modifications can be made by those skilled in the art to the invention just described, only by way of non-limiting examples.

The invention claimed is:

1. A multichannel pipetting system comprising:

a bottom part comprising a plurality of devices, each said device comprising two concentric aspiration chambers; and two end pieces arranged side-by-side and respectively fluidly connected to said two aspiration chambers, wherein one of said two aspiration chambers is concentrically arranged with respect to the other of the two aspiration chambers, wherein each said end piece comprises a through port fluidly connected to one of said two aspiration chambers, and wherein said plurality of devices are arranged such that a center axis of each said end piece intercepts a same straight line, thereby forming a row of said end pieces.

2. The multichannel pipetting system according to claim 1, wherein each of the plurality of devices further comprises two pistons each respectively located in one of said two aspiration chambers, wherein a first of said two pistons has a cylindrical shape and a second of said two pistons has a ring-shape horizontal cross-section in a top plan view.

3. The multichannel pipetting system according to claim 2, wherein said two pistons are each slidable in each of the respective two aspiration chambers in a longitudinal direction that is the same as a center axis of said bottom part.

4. The multichannel pipetting system according to claim 1, wherein a first of said two aspiration chambers has a solid circle-shaped horizontal cross-section in a top plan view, and a second of said two aspiration chambers has an annular-shaped horizontal cross-section in the top plan view.

5. The multichannel pipetting system according to claim 4, wherein the device further comprises two pistons each respectively located in one of said two aspiration chambers, wherein a first one of said two pistons has a cylinder shape and a second one of said two pistons has a ring-shaped horizontal cross-section in the top plan view, wherein said cylinder-shaped piston is located in the first aspiration chamber, wherein said first aspiration chamber comprises a closed end which forms a seal, and wherein said closed end of said first aspiration chamber also forms said first piston.

6. The multichannel pipetting system according to claim 1, wherein a center axis of each said end piece is spaced apart from the other adjacent end piece with a pitch of 9 mm.

7. The multichannel pipetting system according to claim 1, wherein said two aspiration chambers each have an identical horizontal cross-section surface area in a top plan view.

8. The multichannel pipetting system according to claim 1, wherein at least one of said two aspiration chambers of one of said plurality of devices has a different surface area in a horizontal cross-section in a plan view from a surface area of at least one of said two aspiration chambers of at least one other of said plurality of devices of the bottom part.

9. The multichannel pipetting system according to claim 1, wherein said multichannel pipetting system further comprises a handle body which forms an upper part connected to said bottom part.

10. The multichannel pipetting system according to claim 1, wherein said through port of each end piece is off-center in a top plan view with respect to a center axis of a horizontal cross-section of each respective end piece.

* * * * *